United States Patent [19]

Capo et al.

[11] 4,142,635

[45] Mar. 6, 1979

[54] RECLOSABLE BOX WITH TEAR-OPEN SPOUT AND BLANK THEREFOR

[75] Inventors: James L. Capo, Franklin, Ohio; James Daher, New Kensington, Pa.

[73] Assignees: International Paper Company, New York, N.Y.; H. J. Heinz Company, Pittsburgh, Pa.

[21] Appl. No.: 843,484

[22] Filed: Oct. 19, 1977

[51] Int. Cl.[2] ..... B65D 5/54; B65D 5/72

[52] U.S. Cl. ..... 206/622; 206/625; 229/17 R

[58] Field of Search ..... 206/622, 625, 621; 229/7 R, 17 R

[56] References Cited

U.S. PATENT DOCUMENTS

| | | | |
|---|---|---|---|
| 1,470,705 | 10/1923 | Zalkind | 229/17 |
| 1,947,865 | 2/1934 | Marsh | 229/17 |
| 2,162,556 | 6/1939 | Lagaard | 229/17 |
| 2,351,812 | 6/1944 | Guyer | 229/51 |
| 2,361,597 | 10/1944 | Buttery | 229/44 |
| 2,812,127 | 11/1957 | Graybill | 229/17 R |
| 2,931,554 | 4/1960 | Matern | 229/17 |
| 2,956,719 | 10/1960 | Nagle | 229/17 R |
| 3,096,927 | 7/1963 | Graybill | 229/17 R |
| 3,133,689 | 5/1964 | Rossi | 229/17 R |
| 3,147,905 | 9/1964 | Gill | 206/625 |
| 3,270,941 | 9/1966 | Barnes | 206/621 |
| 3,361,327 | 1/1968 | Waldrop | 229/38 |
| 3,372,853 | 3/1968 | Rumberger | 229/17 |
| 3,397,833 | 8/1968 | Champlin | 229/51 |
| 3,438,565 | 4/1969 | Lugt et al. | 229/17 |
| 3,708,109 | 1/1973 | Rosenburgh | 229/17 |
| 3,861,583 | 1/1975 | Tingley et al. | 229/51 TC |

*Primary Examiner*—Stephen P. Garbe

*Attorney, Agent, or Firm*—James F. Haley, Jr.

[57] ABSTRACT

A paperboard box having a tear-open pour spout which is easily constructed from a simple integral blank. The pour spout is sift-proof and readily opened by means of a tongue, unattached to the box. The pour spout and related tear open portion are constructed to be non-interfering with the pouring of the box contents and to be readily reclosed and reopened.

8 Claims, 7 Drawing Figures

RECLOSABLE BOX WITH TEAR-OPEN SPOUT AND BLANK THEREFOR

BACKGROUND OF THE INVENTION

This invention relates to reclosable paperboard cartons. More particularly it is directed at a lightweight but strong paperboard carton characterized by a paperboard sift-proof reclosable pour spout that is configured to permit easy opening, scatter-free pouring, and ready reclosing and reopening.

Cartons made of paperboard having a pour spout in a side partition or on the top or bottom are well-known in the art. Such cartons are particularly well suited to serve as packages for sugar, starch, dry milk, cereal and other granular or powdered items particularly those which are subject to intermittent use by the ultimate consumer. The paperboard pour spout provides a convenient and economical means by which a portion of the contents of the carton may be removed for use. Yet, the spout permits the carton to be reclosed to preserve the remaining material and to protect it against spillage in case of accidental dropping or turning over.

There are a number of desirable attributes that a pour spout paperboard carton should have to maximize its utility and economy. The carton and blank from which it is formed should be readily constructed and particularly amenable to automatic manufacture. Moreover, the resultant carton desirably is strong and resilient enough to absorb the rigors of the marketplace without breaking. Yet, this ready construction and operative strength must be effected with minimal material waste.

The pour spout itself should likewise be of simple construction and afford ready opening and reclosing by the consumer. It should be formed to provide sift-proof packaging of small grained powders and to withstand repeated openings and closings. Further, the spout and related tabs should facilitate content pouring and not serve to scatter the poured powder.

A number of prior art reclosable paperboard cartons accomplish some of these desired objectives. For example, U.S. Pat. Nos. 3,708,109 and 2,361,597 disclose machine-manufactured flip-top type paperboard cartons but neither are sift-proof, being more specifically constructed to package cigars or cigarettes. Moreover, these cartons do not admit easy opening as their opening tabs are available only after glue seal fracture by external pressure. U.S. Pat. No. 3,361,327 discloses an entire top opening container. Again, the initial carton opening must be preceded by external pressure to break the seal of a tearaway top. In remedy of this disadvantageous opening sequence, U.S. Pat. Nos. 3,861,583 and 2,162,556 disclose entire top opening cartons which are characterized by an unattached tab for ready opening. Moreover, U.S. Pat. No. 3,861,583 is assembled from a dual blank of specific shape to minimize paperboard waste. However, none of these cartons are designed for removal of the contents by pouring.

U.S. Pat. Nos. 1,947,865, 2,351,812 and 3,397,833 disclose paperboard cartons which include reclosable pour spouts. However, none admit easy opening. U.S. Pat. No. 2,351,812 requires thin instrument insertion to open (FIG. 2) and U.S. Pat. Nos. 1,947,865 and 3,397,833 require external pressure to break the glue seals and perforations. Moreover, none are sift-proof, each having perforations in communication with the packaged contents. And, at least the carton tab of U.S. Pat. No. 1,947,865 operates to scatter the contents during pouring as the tab extends in the same direction as the pour.

U.S. Pat. Nos. 1,470,705 and 2,931,554 provide unattached tab tongues to avail easy opening of the paperboard pour spout. Further, U.S. Pat. No. 1,470,705 includes a notched end flap portion (32) to aid reopening (FIG. 5). However, neither of these cartons provide sift-proof seals, again the perforation are in communication with the contents. Additionally, the carton of U.S. Pat. No. 1,470,705 is not easily closed as the tab tongue is often blocked by end flap (17) of the carton top during attempted insertion of this tongue between the end flap and dust flaps (15 and 16) (FIGS. 3 and 5).

U.S. Pat. Nos. 3,372,853 and 3,438,565 likewise disclose paperboard cartons with reclosable pour spouts. Both, provide unattached tongues or tabs to permit easy carton opening. However, that of U.S. Pat. No. 3,372,853 is neither sift-proof nor amenable to content pouring without tab interference and scattering. Conversely, the spout of U.S. Pat. No. 3,438,565 is sift-proof, lid portion (74) being larger than and overlying removable spout section (44) and its perforated boundaries (FIG. 3). However, the blank from which the carton of U.S. Pat. No. 3,438,565 is constructed is not easily fabricated. Instead, triangular section 50 must be cut scored into the blank to about one-half the depth of the blank so as to allow section 68 to be peeled therefrom. Moreover, full cut slits 56 and 58 must also be provided in this blank section. The carton of U.S. Pat. No. 3,438,565 is also not easily reopened after closing. Instead tongue 90 has been pushed within the top of the box and is only retrieved with inconvenience.

SUMMARY OF THE INVENTION

Accordingly, it is an object of this invention to provide a lightweight but strong paperboard carton having a paperboard sift-proof reclosable spout which is easy to construct from a paperboard blank.

It is another object of this invention to provide a paperboard carton having a pour spout that is easily opened and readily reclosed and reopened for further use.

It is a further object of this invention to provide a paperboard pour spout whose opening tab does not interfer with or scatter the contents during pouring.

It is another object of this invention to provide a paperboard box which is horizontally fillable.

A still further object of this invention is to provide a lightweight paperboard blank which is easily constructed with minimal material waste and lends itself to the ready formation of the paperboard cartons of this invention.

These and other additional objects and advantages of this invention, apparent from the detailed description and claims which follow, are accomplished by a sift-proof paperboard box having a top closure adapted to form a tear-open pour spout and an integral blank from which it is formed.

The box of this invention preferably comprises a bottom wall; two upstanding side walls foldably connected to opposite edges of the bottom wall; a top closure comprising inwardly folded inner and outer panels adhesively affixed to one another, one of said panels foldably connected to the top edge of each side wall, and the inner panel including a removable portion disposed within perforation slits, such slits being free from adhesive, and the outer panel including a lid portion defined by two opposite spaced perforation slits, a hinge means, and the edge of the outer panel opposite the hinge means and transverse to that fold connecting the outer panel to the side wall, the lid being larger than, overlying and adhesively affixed to the removable portion of the inner panel; a first end closure comprising an inwardly folded top dust flap, the flap being foldably connected to that edge of the outer panel section of the top closure opposite that edge defining the lid portion thereof; an inwardly folded bottom dust flap, the flap being foldably connected to the edge of the bottom wall opposite the top dust flap; and inwardly folded inner and outer panels, each of these panels being foldably connected to similarly located side edges of each side wall, the inner panel being adhesively affixed to the top and bottom dust flaps, and the outer panel being adhesively affixed to the inner panel; and a second end closure comprising an inwardly folded top dust flap, the flap being foldably connected to the inner panel of the top closure along that edge opposite the first end closure; an inwardly folded bottom dust flap, the flap being foldably connected to a similar edge of the bottom wall; inwardly folded inner and outer panels, each of the panels being foldably connected to the other side edges of each side wall, these edges being opposite those foldably connected to the inner and outer panels of the first end closure, the inner panel being adhesively affixed to the top and bottom dust flap and being partially cut-out in that portion overlying the top dust flap, and the outer panel being adhesively affixed to the inner panel and being partially cut-out in that portion overlying the cut-out portion of the inner panel; and a flap foldably connected to that edge of the outer panel of the top closure defining the lid portion thereof, the flap being adhesively affixed to the outer panel of the second end closure along selected zones thereof and being comprised of a tongue portion, an internal cut-out portion, and an outer tab edge, the tongue portion, not adhesively affixed to the outer panel, being defined by two perforation slits, the cut-out portion and that fold connecting the flap to the outer panel of the top closure, the slits that separate the tongue portion from the outer tab edge extending through the fold and being continuous with the perforated slits defining the lid portion of the top closure, the internal cut-out portion being defined by the free unperforated edge of the tongue portion and the outer tab edge, and the outer tab edge being adhesively affixed to the outer panel of the second end closure.

In similar fashion the blank of this invention preferably comprises a bottom wall panel and two adjacent upstanding side wall panels, one edge of each side wall panel being foldably connected to opposite edges of the bottom wall panel; top closure inner and outer panels, one of the panels foldably connected to the edge of each side wall panel opposite that side wall panel's connection to the bottom wall panel, the top closure inner panel including a removable portion disposed within perforation slits, and the top closure outer panel including a lid portion defined by two opposite spaced perforation slits, a hinge means and the edge of the outer panel opposite the hinge means and transverse to that fold connecting the outer panel to the side wall, the lid being larger than the removable portion of the inner panel and disposed so as to overlay that removable portion in the formed box; two first end closure dust flap panels, one of these panels foldably connected to that edge of the top closure outer panel opposite that defining the lid portion thereof and the other of these panels foldably connected to a similar edge of the bottom wall panel and first end closure inner and outer panels, one of these panels foldably connected to the edge of each side wall panel adjacent the above described first end closure dust flaps; second end closure inner and outer panels, one of the panels foldably connected to that similar edge of each side wall panel opposite to that side wall panel's connection to the first end closure inner and outer panels, and two second end closure dust flap panels, one of these panels foldably connected to that end of the top closure inner panel adjacent the second end closure inner and outer panels and the other of these panels foldably connected to that end of the bottom wall panel adjacent the second end closure inner and outer panels and a second end closure flap panel foldably connected to the edge of the top closure outer panel adjacent the second end closure inner and outer panels, the second end closure inner panel having a cut out portion along that edge adjacent the edge of a panel selected from the group comprising the second end closure dust flap panel foldably connected to the top closure inner panel and the second end closure flap panel, the second end closure outer panel having a smaller cut out portion along that edge adjacent to the other of those panels, and the second closure flap panel comprising a tongue portion, an internal cut-out portion and an outer tab edge, the tongue portion being defined by two perforation slits separating the tongue portion from the outer tab edge, the cut out portion, and that fold connecting the flap to the top closure outer panel, the slits extending through the fold and being continuous with that end of the perforated slits of the lid portion of the top closure outer panel defined by that edge of that outer panel opposite the hinge means, the internal cut out portion being defined by the free edge of the tongue portion and the outer tab edge.

DETAILED DESCRIPTION OF THE INVENTION

Figure 1:
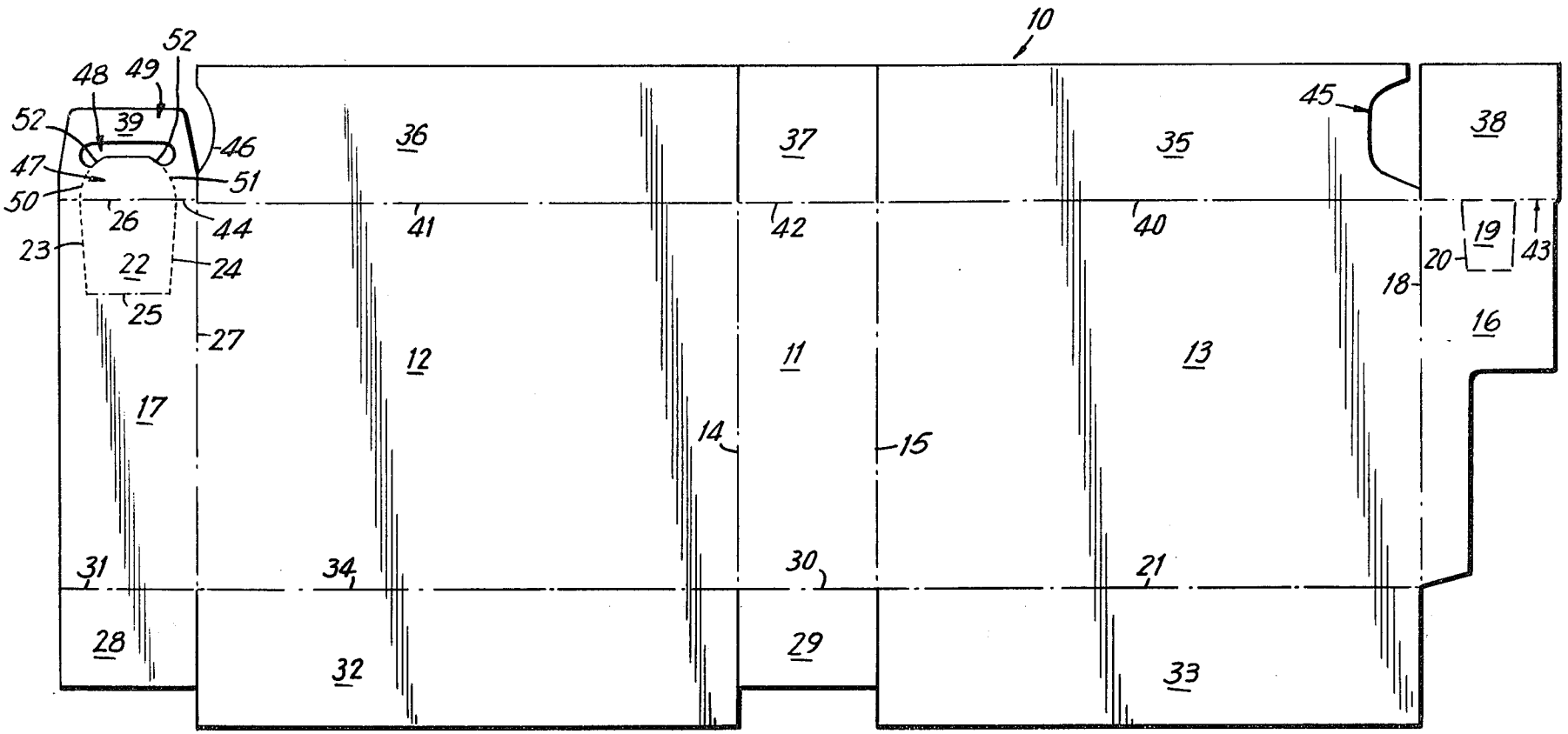
FIG. 1 is a plan view of an embodiment of a blank of this invention from which a preferred embodiment of the box of this invention may be constructed.

Referring to FIG. 1, one embodiment of a blank 10 of this invention is shown. This integral blank may be constructed of the usual paperboard materials well-known in the art. Such construction may include various paperboard surface treatments to improve the product preserving properties or characteristics of boxes formed from such blanks. The choice of such materials or treatments forms no part of this invention. However, it is a surprising feature of this invention that paperboard blanks of less thickness may be used in the box formation. For example 18–20 point board instead of the more usual 22–24 point board may be employed to good advantage. It is believed that this savings of material is due to the specific double board overlap in the area of the pour spout in the box of this invention, such pour spout vicinity being the more usual site of prior box failure.

The integral box 10 is cut and scored to provide a bottom wall panel 11 and two adjacent side wall panels 12 and 13, one edge of each side wall panel being foldably connected through score lines 14 and 15 respectively to opposite edges of the bottom wall panel 11. Top closure inner panel is foldably connected through score line 18 to the edge of side wall 13 opposite that wall's foldable connection 15 to bottom wall 11. It includes a removable portion 19 disposed within perforation slits 20. While in the preferred embodiment depicted in FIG. 1 top closure inner panel 16 is partially cut away above an extension of score line 21, such omitted portion may be included in the blanks of this invention. However, the full inclusion of top closure inner panel above the extension of score line 21 is wasteful of material. The actual shape of the panel 16 is not critical. Rather, the panel is required only in the area of removable portion 19 to reinforce the resultant pour spout and along the entire edge of score line 18 to afford a glue panel to form the initial box tube in standard fashion.

Figure 3:
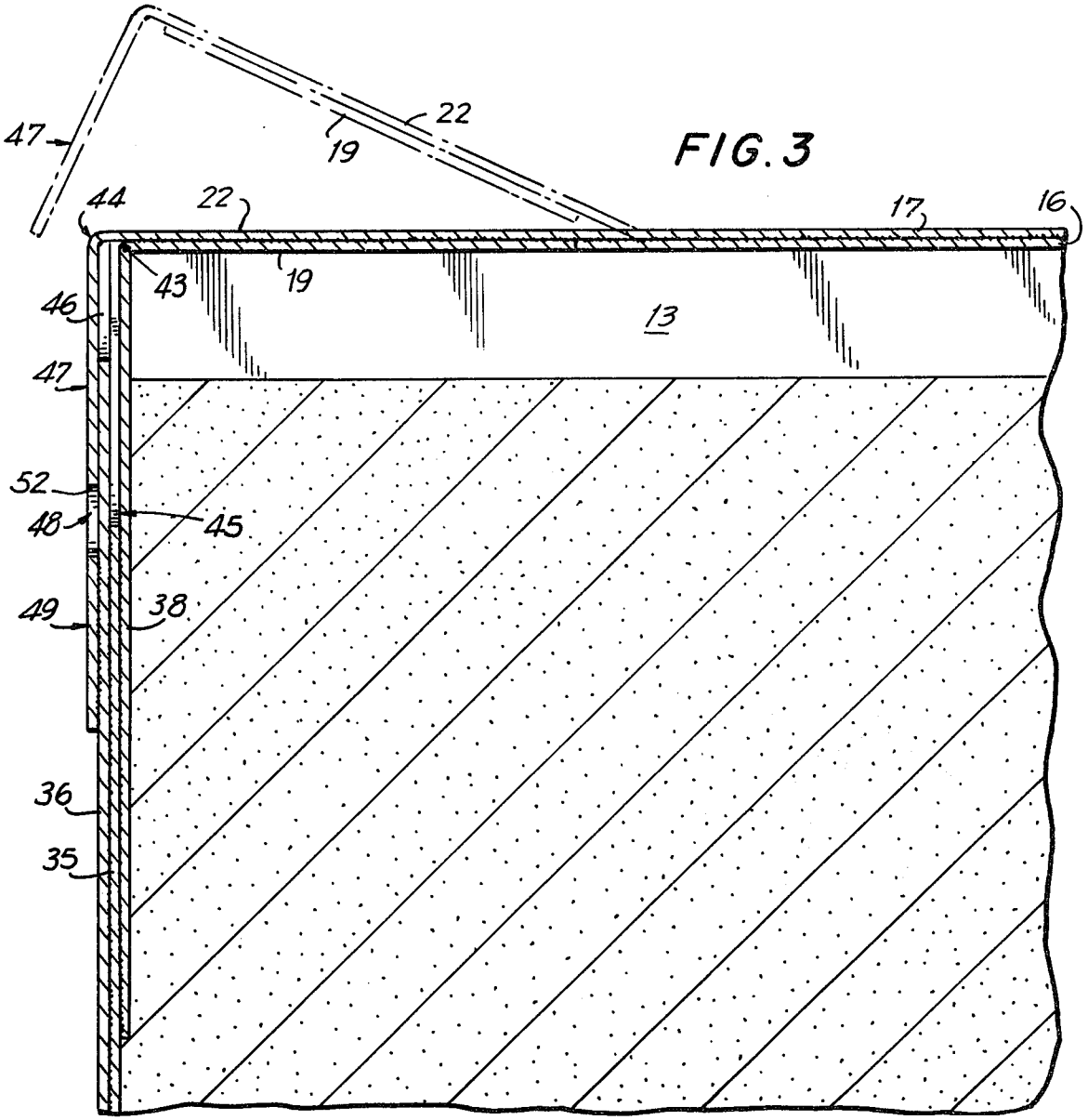
FIG. 3 is a cross-sectional view taken along lines 3—3 of the box of FIG. 2, the pour spout is pictured both open and closed for purposes of clarity.

Top closure outer panel 17 is foldably connected through score line 27 to the edge of side wall 12 opposite that wall's foldable connection 14 to bottom wall 11. It includes a lid portion 22 defined by two opposite spaced perforation slits 23 and 24, a scored hinge means 25 and the edge 26 of top closure outer panel 17 opposite the hinge means and transverse to that score line fold 27 connecting the outer panel to the side wall 12. The lid portion is larger than the removable portion 19 of inner panel 16 and as best shown in FIG. 3 is disposed so as to overlay that removable portion in the formed box.

The blank also provides two first end closure dust flap panels 28 and 29. Top flap 28 is foldably connected through fold 31 to that edge of top closure outer panel 17 opposite that edge 26 of the panel defining the lid portion 22 thereof. Bottom dust flap panel 29 is foldably connected through fold 30 to a similar edge of bottom wall panel 11. The first end closure also includes inner and outer panels 32 and 33 respectively. Each of these panels are foldably connected to similar located edges, 34 and 21 respectively, of each side wall panel 12 and 13.

The second end closure includes inner and outer panels 35 and 36, dust flap panels 37 and 38, and flap panel 39. As depicted, inner panel 35 is foldably connected through fold 40 to side wall 13 along that edge opposite the side wall panel's connection 21 to the first end closure inner panel 33. Similarly, second end closure outer panel 36 is foldably connected along fold 41 to the other side wall 12 opposite first end closure outer panel 32. It should be understood that such inner or outer panel could as well be foldably connected to the edge of the other side wall than is depicted in FIG. 1. Bottom dust flap panel 37 is foldably connected along fold 42 to that end of bottom wall panel 11 adjacent second end closure inner and outer panels 35 and 36. Top dust flap panel 38 is foldably connected along fold 43 to the end of top closure inner panel 16 adjacent second end closure inner and outer panels 35 and 36. Flap panel 39 is similarly connected to top closure outer panel 17 along fold line 44.

Figure 1A:
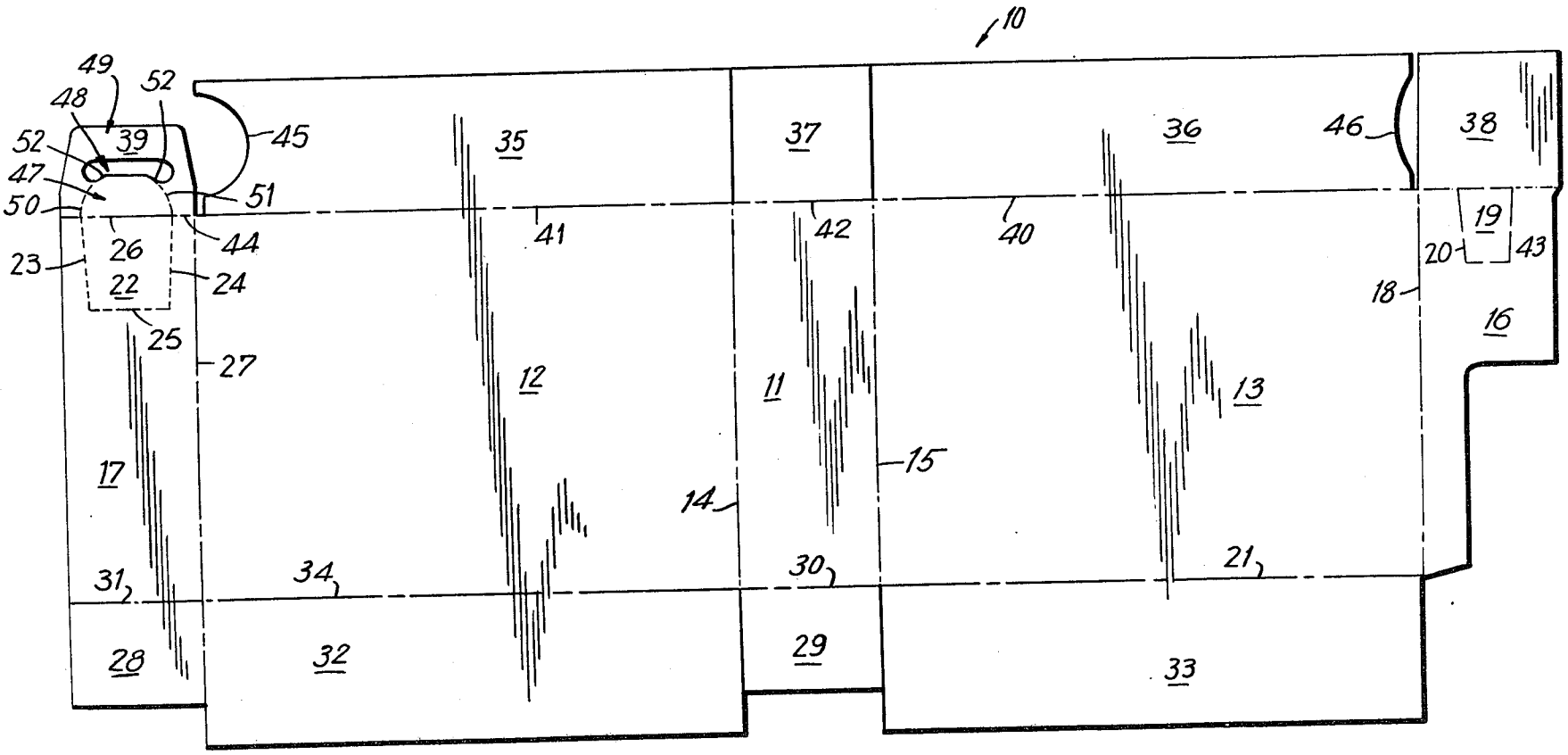
FIG. 1A is a plan view of another embodiment of a blank of this invention from which an embodiment of the box of this invention may be constructed.
Figure 6:
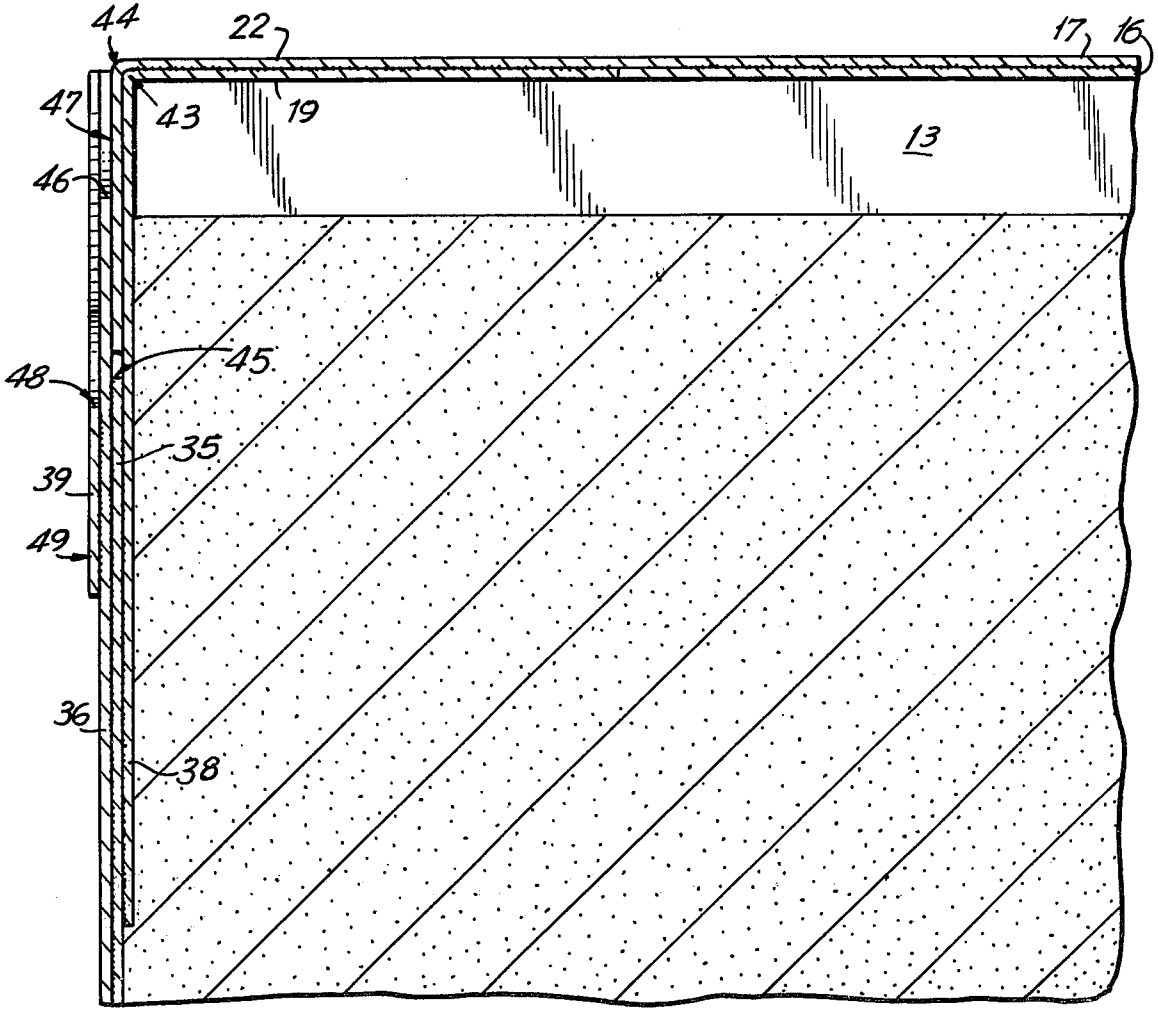
FIG. 6 is a cross-sectional view taken along lines 6—6 of the box of FIG. 5.
Figure 5:
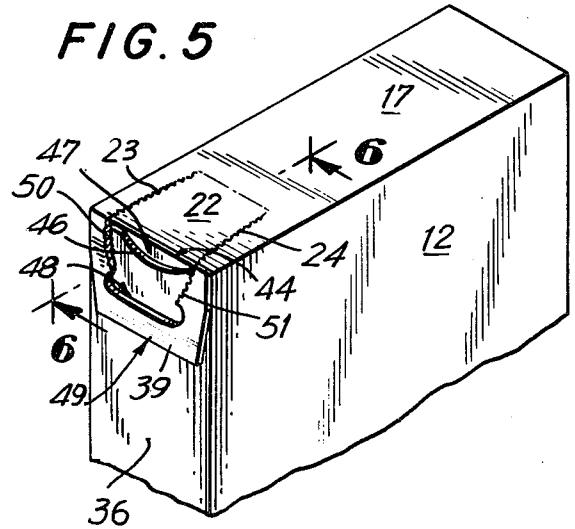
FIG. 5 is a partial perspective view of the box of FIG. 2, the pour spout being reclosed.

The second end closure inner panel has a cut-out portion along that edge adjacent the edge of the second end closure dust flap panel foldably connected to the top closure inner panel or the second end closure flap panel foldably connected to the top closure outer panel. In analogous fashion the second end closure outer panel also has a smaller cut-out portion along that edge adjacent to the other of those panels. As depicted in FIG. 1, that embodiment is shown wherein inner panel 35 has its cut-out portion 45 adjacent the edge of second end closure dust flap panel 38 and outer panel 36 has its smaller cut-out portion 46 adjacent second end closure flap panel 39. FIG. 1A illustrates the other of these embodiments wherein inner panel 35 has its cut-out portion 45 adjacent second end closure flap panel 39 and outer panel 36 has its cut-out portion 46 adjacent second end closure dust flap panel 38. Although the absolute shape and size of these cut-out portions is not critical, it is preferred that cut-out portion 45 be of sufficient size and shape to accommodate without interference the reclosed tongue portion of the tear open spout. Conversely, cut-out portion 46 need only be smaller than portion 45 to permit reclosure yet avail easy reopening of the pour spout by exposing a portion of the surface thereof. These attributes are best shown in FIGS. 5 and 6.

Flap panel 39 includes a tongue portion 47, an internal cut-out portion 48 and an outer tab edge 49. The tongue portion 47 is defined by two perforation slits 50 and 51 which separate the tongue portion from the outer tab edge 49, the cut-out portion 48, and that fold 26 connecting the flap to the top closure outer panel 17. The slits 50 and 51 extend through fold 26 and are continuous with that end of perforated slits 23 and 24 of lid portion 22 of the top closure outer panel 17 defined by that edge 26 of the outer panel opposite hinge means 25. The internal cut-out portion 48 is defined by the outer tab edge 49 and the free edge 52 of tongue 47.

Figure 2:
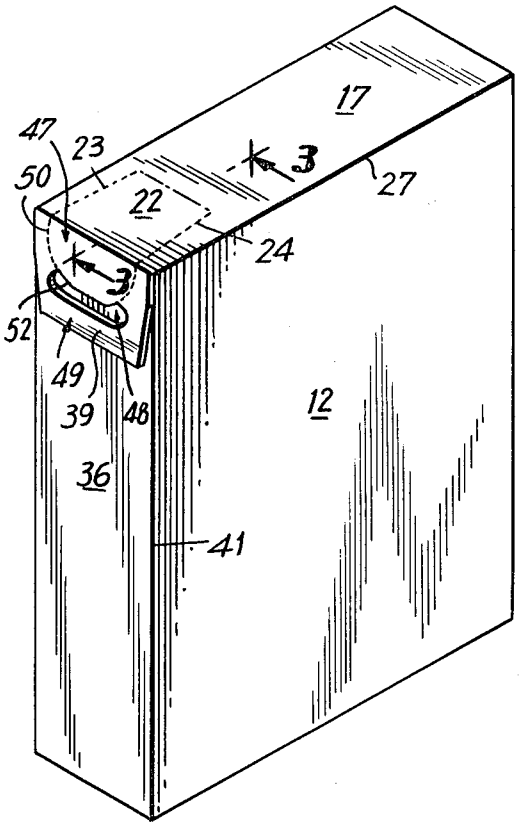
FIG. 2 is a perspective view of a preferred embodiment of the box of this invention formed from the blank of FIG. 1 and sealed.

The blank of FIG. 1 is formed into a box such as that shown in FIG. 2 by any number of well-known box forming techniques. In such formation top closure inner panel 16 and outer panel 17 are adhesively affixed to each other and removable portion 19 is affixed to the underside of lid portion 22, perforations 20, 23 and 24 being free of adhesive. This arrangement advantageously provides a double paperboard thickness about the pour spout of this invention. Such box tube may be filled horizontally. The first end closure is formed by inwardly folding dust flap panels 28 and 29 and adhesively affixing them to the underside of inner panel 33 which in turn is adhesively affixed to the underside of outer panel 32. The second end closure is effected by inwardly folding dust flaps 37 and 38 and adhesively affixing them to the underside of inner panel 35 which in turn is affixed to the underside of outer panel 36. Finally, flap 39 is folded on top of outer panel 36 and adhesively affixed thereto around outer tab edge 49. Tongue 47 is not affixed to panel 36.

Figure 4:
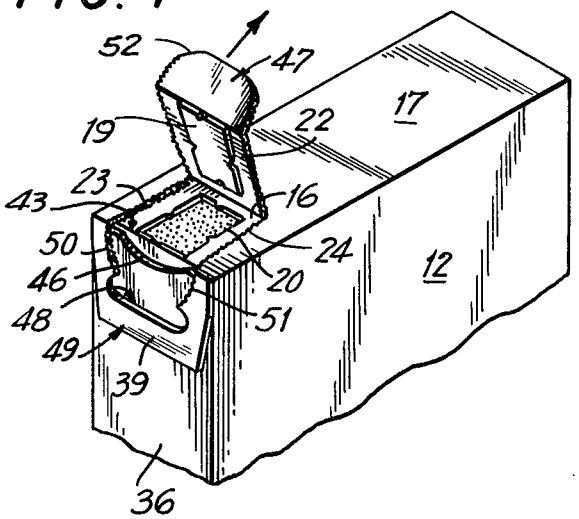
FIG. 4 is a partial perspective view of the box of FIG. 2, the pour spout being opened.

Referring to FIGS. 2 and 4, the tear-open spout of this invention is illustrated. By gripping free edge 52, protruding into internal cut-out space 48, tongue 47 may be ripped along perforations 50 and 51 and 23 and 24 to tear open lid portion 22. Such tear-away simultaneously removes removable portion 19 from top closure inner panel 16 opening the box. The open box is now amenable to contents pouring without lid portion 22 interference or scattering.

As best shown in FIGS. 5 and 6, this tear open lid may be easily reclosed to preserve the unused box contents. Tongue 47 is inserted between second end closure outer panel 36 and top dust flap 38. Preferably the second end closure inner panel 35 is cut away sufficiently as shown in FIGS. 3 and 6 to easily accommodate the inserted tongue. On reopening cut away portion 46 in outer panel 36 provides ready access to the inserted tongue 47.

Therefore, the preferred box of this invention is easily constructed from a simple integral blank with maximal and improved material usage efficiency. It provides a simple paperboard sift-proof tear open spout which is quickly available for opening. The opening tab does not interfere with pouring of the contents, is easily reclosable without inner panel interference, and avails quick reopening.

While I have hereinbefore presented a number of embodiments of our invention, it is apparent that my basic construction can be altered to provide other embodiments which utilize my invention. Thus, it will be appreciated that the scope of my invention is to be defined by the claims appended hereto rather than the specific embodiments which have been presented hereinbefore by way of example.

I claim:

1. A paperboard box having a top closure adapted to form a tear-open pour spout, the box comprising:

a bottom wall;

two upstanding side walls foldably connected to opposite edges of the bottom wall;

a top closure comprising inwardly folded inner and outer panels adhesively affixed to one another, each of said panels foldably connected to the top edge of a side wall, and the inner panel including a removable portion disposed within perforation slits, such slits being free from adhesive, and the outer panel including a lid portion defined by two opposite spaced perforation slits, a hinge means, and the edge of the outer panel opposite the hinge means and transverse to that fold connecting the outer panel to the side wall, the lid being larger than, overlying and adhesively affixed to the removable portion of the inner panel;

a first end closure comprising an inwardly folded top dust flap, the flap being foldably connected to that edge of the outer panel section of the top closure opposite that edge defining the lid portion thereof; an inwardly folded bottom dust flap, the flap being foldably connected to the edge of the bottom wall opposite the top dust flap; and inwardly folded inner and outer panels, each of these panels being foldably connected to similarly located side edges of each side wall, the inner panel being adhesively affixed to the top and bottom dust flaps, and the outer panel being adhesively affixed to the inner panel; and a second end closure comprising an inwardly folded top dust flap, the flap being foldably connected to the inner panel of the top closure along that edge opposite the first end closure; an inwardly folded bottom dust flap, the flap being foldably connected to a similar edge of the bottom wall; inwardly folded inner and outer panels, each of the panels being foldably connected to the other side edges of each side wall, these edges being opposite those foldably connected to the inner and outer panels of the first end closure, the inner panel being adhesively affixed to the top and bottom dust flap and being partially cut out in that portion overlying the top dust flap, and the outer panel being adhesively affixed to the inner panel and being partially cut out in that portion overlying the cut-out portion of the inner panel; and a flap foldably connected to that edge of the outer panel of the top closure defining the lid portion thereof, the flap being adhesively affixed to the outer panel of the second end closure along selected zones thereof and being comprised of a tongue portion, an internal cut-out portion, and an outer tab edge, the tongue portion, not adhesively affixed to the outer panel, being defined by two perforation slits, the cut-out portion and that fold connecting the flap to the outer panel of the top closure, the slits that separate the tongue portion from the outer tab edge extending through the fold and being continuous with the perforated slits defining the lid portion of the top closure, the internal cut-out portion being defined by the free unperforated edge of the tongue portion and the outer tab edge, and the outer tab edge being adhesively affixed to the outer panel of the second end closure.

2. The box of claim 1 wherein the top closure inner panel is partially cut away, the remaining portion comprising a portion in the vicinity of the removable portion and the foldable connection of the inner panel to the second end closure dust flap and a glue flap portion along the entire edge of the side panel to which the inner panel is foldably attached.

3. The box of claim 1 wherein the partial cut-out portion of the second end closure inner panel has a size and shape corresponding to the tongue portion of the second end closure flap panel.

4. The box of claim 1 wherein the removable portion of the top closure inner panel is contiguous with that fold connecting the inner panel to the second end closure dust flap.

5. The blank of claim 4 wherein the top closure inner panel is partially cut away, the remaining portion comprising a portion in the vicinity of the removable portion and the foldable connection of the inner panel to the second end closure dust flap and a glue flap portion along the entire edge of the side panel to which the inner panel is foldably attached.

6. The blank of claim 4 wherein the cut-out portion of the second end closure inner panel has a size and shape corresponding to the tongue portion of the second end closure flap panel.

7. The box of claim 1 wherein the removable portion of the top closure inner panel is contiguous with that fold connecting the inner panel to the second end closure dust flap panel.

8. An integral paperboard blank for forming a box having a top closure adapted to form a tear-open pour spout cut and scored to provide;

a bottom wall panel and two adjacent side wall panels, one edge of each side wall panel being foldably connected to opposite edges of the bottom wall panel;

top closure inner and outer panels, each of the panels foldably connected to the edge of a side wall panel opposite that side wall panel's connection to the bottom wall panel, the top closure inner panel including a removable portion disposed within perforation slits, and the top closure outer panel including a lid portion defined by two opposite spaced perforation slits, a hinge means and the edge of the outer panel opposite the hinge means and transverse to that fold connecting the outer panel to the side wall, the lid being larger than the removable portion of the inner panel and disposed so as to overlay that removable portion in the formed box;

two first end closure dust flap panels, one of these panels foldably connected to that edge of the top closure outer panel opposite that defining the lid portion thereof and the other of these panels foldably connected to a similar edge of the bottom wall panel, and first end closure inner and outer panels, each of these panels foldably connected to the edge of a side wall panel adjacent the above described first end closure dust flaps;

second end closure inner and outer panels, each of the panels foldably connected to a similar edge of a side wall panel opposite to that side wall panel's connection to the first end closure inner and outer panels, and two second end closure dust flap panels, one of these panels foldably connected to that end of the top closure inner panel adjacent the second end closure inner and outer panels and the other of these panels foldably connected to that end of the bottom wall panel adjacent the second end closure inner and outer panels, and a second end closure flap panel foldably connected to the edge of the top closure outer panel adjacent the second end closure inner and outer panels, each of the second end closure inner and outer panels having cut-out portions along an edge opposite the second end closure dust flap panel foldably connected to the bottom wall panel, the cut-out portion of the second end closure inner panel being larger than the cut-out portion of the second end closure outer panel, and the second end closure flap panel comprising a tongue portion, an internal cut-out portion and an outer tab edge, the tongue portion being defined by two perforation slits separating the tongue portion from the outer tab edge, the cut-out portion and that fold connecting the flap to the top closure outer panel, the slits extending through the fold and being continuous with that end of the perforated slits of the lid portion of the top closure outer panel defined by the edge of that outer panel opposite the hinge means, the internal cut-out portion being defined by the free edge of the tongue portion and the outer tab edge.

* * * * *

UNITED STATES PATENT AND TRADEMARK OFFICE

CERTIFICATE OF CORRECTION

PATENT NO. : 4,142,635

DATED : March 6, 1979

INVENTOR(S) : James L. Capo et al.

It is certified that error appears in the above-identified patent and that said Letters Patent are hereby corrected as shown below:

Page 1, column 2, References Cited, change "3,096,927" to --3,096,922--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*